US009320324B2

(12) United States Patent
Girard

(10) Patent No.: US 9,320,324 B2
(45) Date of Patent: Apr. 26, 2016

(54) FOOTWEAR CRAMPON

(71) Applicant: SALOMON S.A.S., Metz-Tessy (FR)
(72) Inventor: François Girard, Veyrier du Lac (FR)
(73) Assignee: SALOMON S.A.S, Metz-Tessy (FR)

( * ) Notice: Subject to any disclaimer, the term of this patent is extended or adjusted under 35 U.S.C. 154(b) by 248 days.

(21) Appl. No.: 13/898,909
(22) Filed: May 21, 2013
(65) Prior Publication Data
US 2013/0312282 A1 Nov. 28, 2013
(30) Foreign Application Priority Data
May 22, 2012 (FR) ..... 12 01444
(51) Int. Cl.
*A43B 3/16* (2006.01)
*A43C 15/06* (2006.01)
*A43B 3/18* (2006.01)
(52) U.S. Cl.
CPC ..... *A43C 15/068* (2013.01); *A43B 3/16* (2013.01); *A43B 3/18* (2013.01); *A43C 15/06* (2013.01); *A43C 15/061* (2013.01); *A43C 15/063* (2013.01); *A43C 15/066* (2013.01)
(58) Field of Classification Search
CPC ..... A43B 3/16; A43B 3/18; A43B 13/36; A43C 13/02; A43C 13/12; A43C 15/00; A43C 15/02; A43C 15/06; A43C 15/065; A43C 15/066; A43C 15/068
USPC ..... 36/7.1 R, 7.5, 7.6, 7.7, 138
See application file for complete search history.

(56) References Cited

U.S. PATENT DOCUMENTS 1,964,442 A * 6/1934 Roche ..... 36/62
3,755,929 A * 9/1973 Frisch et al. ..... 36/7.6
4,156,316 A * 5/1979 DeFever ..... 36/132
4,258,483 A * 3/1981 Hogue ..... 36/135
5,481,814 A * 1/1996 Spencer ..... 36/138
5,666,746 A * 9/1997 Pollard ..... 36/135
5,842,290 A * 12/1998 Mills ..... 36/7.5
(Continued)

FOREIGN PATENT DOCUMENTS

EP 1 464 243 A1 10/2004
FR 2 771 301 A1 5/1999
WO WO-2010/122595 A1 10/2010

OTHER PUBLICATIONS

U.S. Appl. No. 13/898,893 (François Girard), filed May 21, 2013.
(Continued)

*Primary Examiner* — Marie Bays
(74) *Attorney, Agent, or Firm* — Greenblum & Bernstein, P.L.C.

(57) ABSTRACT

A crampon including a body extending lengthwise from a rear end to a front end, widthwise between a first side and a second side, and heightwise between a supporting surface and a receiving surface, the crampon including points projecting in the area of the supporting surface, as well as a first member for retaining a boot in the area of the receiving surface, the first retaining member being movable between a locking position and an unlocking position, the crampon further including an elastic mechanism provided for biasing the first retaining member toward the locking position. On the side of the receiving surface, the crampon includes a return adapted to cooperate with the boot, the return biasing the first retaining member toward the unlocking position when the boot approaches the receiving surface, the return allowing the first retaining member to move back toward the locking position when the boot is in place on the receiving surface.

21 Claims, 5 Drawing Sheets

(56) References Cited

U.S. PATENT DOCUMENTS

| | | | | |
|---|---|---|---|---|
| 6,138,385 | A * | 10/2000 | Jungkind et al. | 36/97 |
| 6,966,127 | B2 | 11/2005 | Petzl et al. | |
| 7,596,890 | B2 * | 10/2009 | Francis | 36/117.4 |
| 2003/0037461 | A1 * | 2/2003 | Petzl et al. | 36/7.6 |
| 2005/0066543 | A1 * | 3/2005 | Rosen et al. | 36/7.5 |
| 2012/0066939 | A1 * | 3/2012 | Codega | 36/59 C |
| 2013/0312281 | A1 * | 11/2013 | Girard | 36/62 |

OTHER PUBLICATIONS

U.S. Appl. No. 13/899,134 (François Girard), filed May 21, 2013.

* cited by examiner

FOOTWEAR CRAMPON

CROSS-REFERENCE TO RELATED APPLICATION

This application is based upon French patent application No. 12/01444, filed May 22, 2012, the disclosure of which is hereby incorporated by reference thereto in its entirety, and the priority of which is claimed under 35 U.S.C. §119.

BACKGROUND

1. Field of the Invention

The invention relates to a crampon adapted to be affixed to an article of footwear, such as a boot. Such crampon may be used in disciplines such as mountaineering, walking or climbing on snow or ice, climbing frozen waterfalls, or the like.

2. Background Information

Conventionally, a crampon comprises a body extending lengthwise from a rear end to a front end, widthwise between a first side and a second side, and heightwise between a supporting surface and a receiving surface. In fact, the body is dimensioned so that the receiving surface receives the sole of the boot. The crampon includes points projecting in the area of the supporting surface, in order to be anchored into the ground, or support surface, and thus prevent slipping. The crampon further comprises means for retaining the boot in the area of the receiving surface. These means constitute a binding, that is to say, a system for fastening to the boot as defined in the standard NF EN 893:2011-01. In general, the binding includes one or more members for retaining the boot in the area of the receiving surface.

For example, according to the document WO 2010/122595, the boot retaining member is movable between a locking position and an unlocking position, an elastic mechanism biasing the retaining member towards the locking position. In practice, a user manually biases the retaining member toward the unlocking position, against the action of the elastic mechanism, in order to enable the boot to be positioned on the receiving surface of the body. Thereafter, the release of the retaining member enables the elastic mechanism to push the retaining member toward the locking position. If the boot is in the boot attachment position, it is then retained on the crampon by the retaining member.

The document WO 2010/122595 describes a crampon for which the retaining member positively holds the boot, due to the action of the elastic mechanism. The retention is positive as opposed to an adhesive retention. More specifically, the retaining member here is comprised of a pair of fingers adapted to be inserted into open cavities of the boot. The fingers prevent the release of the boot during use. The crampon according to this document is satisfactory in the sense that the retention of the boot is reliable. This means that the user does not risk losing the crampon while walking or climbing, and the retention is not likely to vary in accuracy when the crampon is in use. The forces and supports associated with walking, running, or climbing, as well as all sensory information, are transmitted with great accuracy between the crampon and the boot.

Although the conditions of implementation of the crampon according to the document WO 2010/122595 are good, they could be further improved. Indeed, the positioning of the crampon on the boot is difficult and has certain disadvantages.

First, in attaching the crampon the user is caused to assume a body position that is not particularly safe because the user must either bend down or stand on one leg, while bringing the foot of the other leg toward the hand, in order to operate the retaining member. In either case, the user is not well-balanced, i.e., not in a normal walking position, which can prove dangerous. This would be the case, for example, if the crampon is positioned while the user is on a ridge, at the edge of a crevasse, or the like.

In addition to safety, the question of the difficulty in attaching the crampon should also be taken into account, because the retaining member is not accessible at the time the crampon is positioned on the boot. The crampon attachment is even more difficult in powder snow or in a deep snow environment, as the snow tends to cover the crampon and its retaining member, and tends to clog the cavities of the boot provided to receive the retaining fingers.

Also notable is the problem related to the crampon attachment speed. Indeed, the retaining member requires quite a long and non-negligible period of time to cooperate with the boot in order to retain it on the crampon. This time is related to manipulation, and to the need for the user to manage his/her position and/or balance. Consequently, an overly long period of time for crampon attachment decreases safety.

SUMMARY

In view of the foregoing, the invention generally improves a crampon adapted to be affixed to a boot. More specifically, the invention seeks to optimize the safety of the user when the crampon is attached to the boot or article of footwear. In particular, the invention reduces the risk of loss of balance when the crampon is being positioned.

The invention also makes it easier to attach the crampon to the boot, including in an environment in which snow or ice formations tend to cover the crampon.

Furthermore, the invention increases the crampon attachment speed; that is to say, the invention reduces the time required for this operation.

To this end, the invention provides a crampon comprising a body extending lengthwise from a rear end to a front end, widthwise between a first edge and a second edge, and heightwise between a supporting surface and a receiving surface, the crampon comprising points projecting in the area of the supporting surface, as well as a first member for retaining the boot in the area of the receiving surface, the first retaining member being movable between a locking position and an unlocking position, the crampon further comprising an elastic mechanism provided to bias the first retaining member toward the locking position.

On the side of the receiving surface, the crampon according to the invention includes a return for engaging the boot, the return biasing the first retaining member towards the unlocking position when the boot approaches the receiving surface, the return allowing the first retaining member to move back to the locking position when the boot is in position on the receiving surface.

The return uses the displacement of the boot toward the receiving surface to bias the locking member, that is, the first retaining member, in an unlocking direction, against the action of the elastic mechanism. It will be shown later that the bias can be direct or indirect. Irrespectively, however, only the action of the foot, through the leg, is needed to position the crampon on the boot. Thus, no manual action is required. The crampon attachment is carried out simply by pushing towards the receiving surface, after positioning the crampon flat, with the points against the ground. When inserting the boot, the user can maintain a stable standing position, without having to bend down or fold a leg to bring the foot closer to the hand. The user can thus advantageously maintain balance more easily, thereby preserving safety.

Also, the crampon attachment is easier, because the movements necessary for attachment are simple and reduced to a minimum. In particular, no manual operation is required to obtain the locking, since the crampon is positioned on the ground.

Further, crampon attachment is fast, because little time is required because of the simplicity of this operation.

In general, the invention provides an improved crampon structured and arranged to be affixed to a boot.

BRIEF DESCRIPTION OF DRAWINGS

Other characteristics and advantages of the invention will better understood from the description that follows, with reference to the annexed drawings illustrating, by way of non-limiting embodiments, how the invention can be embodied, and in which.

DETAILED DESCRIPTION

The first embodiment described below relates to crampons for mountaineering, walking on snow or ice, as well as climbing on a frozen waterfall. However, the invention is applicable to other disciplines requiring the use of such crampons.

The first embodiment is described below with reference to FIGS. 1-5.

Figure 1:
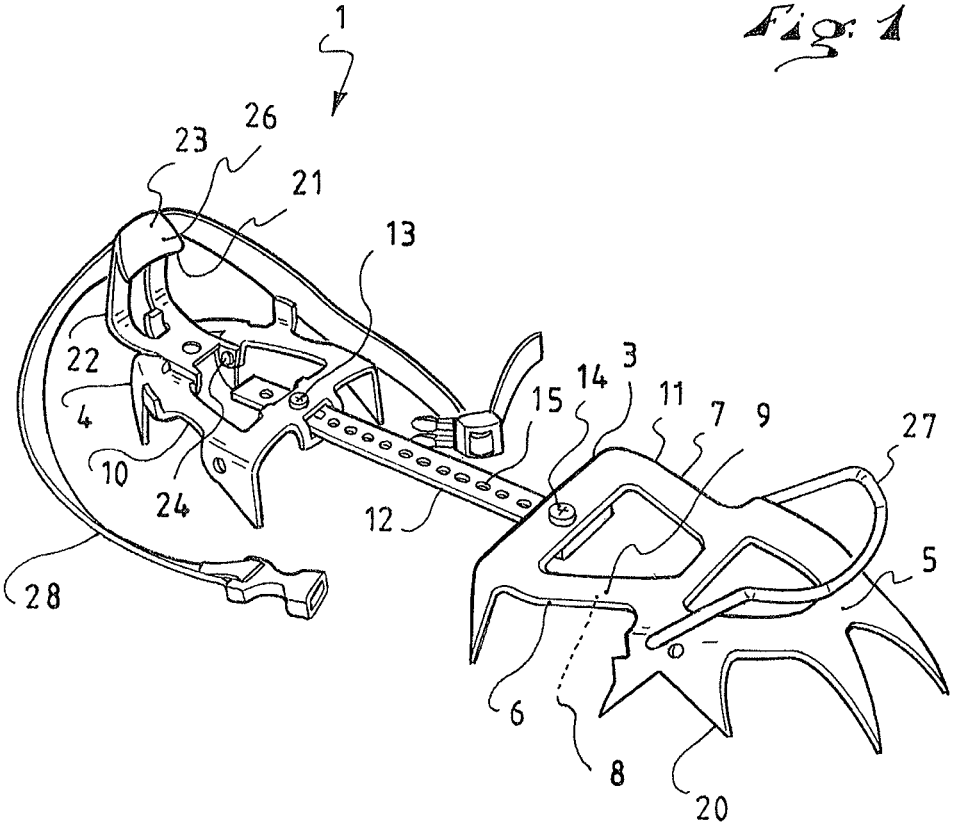
FIG. 1 is a front perspective view of a crampon according to a first embodiment of the invention.
Figure 2:
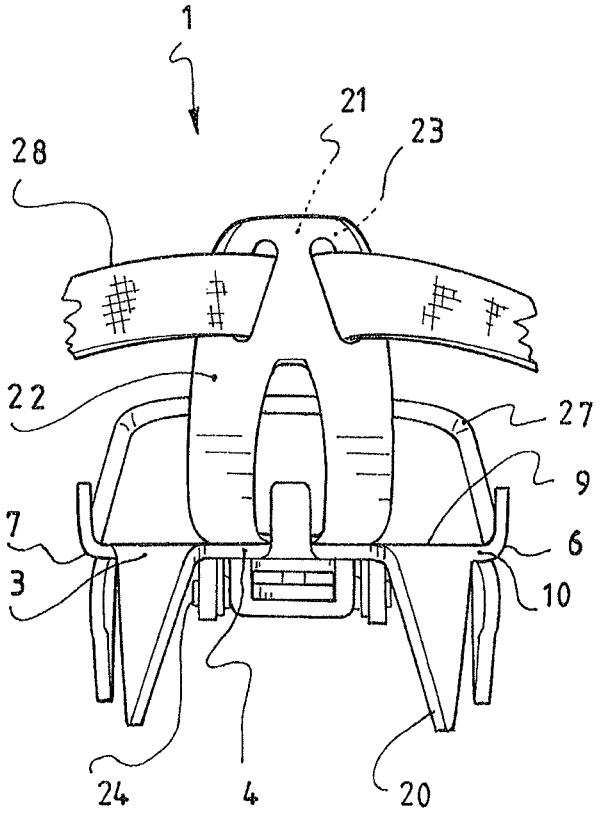
FIG. 2 is a rear view of the crampon of FIG. 1.

FIG. 1 illustrates a crampon 1, provided to receive a boot 2, as described below, includes a body 3 extending lengthwise from a rear end 4 to a front end 5, widthwise between a first side 6 and a second side 7, and heightwise between a supporting surface 8 and a receiving surface 9. The supporting surface 8 is provided to be positioned facing the ground, whereas the receiving surface 9 is structured and arranged to receive the sole assembly of the boot 2.

In a non-limiting manner, the length of the crampon 1 is adjustable to adapt to boots of various sizes, that is to say, of various lengths. To this end, the body 3 comprises a rear plate 10 and a front plate 11, as well as a bridge 12, or center bar, connecting the front 10 and rear 11 plates to one another. A first linkage 13, or fastener, connects the rear plate 10 and the bridge 12 to one another, and a second linkage 14, or fastener, connects the front plate 11 and the bridge 12 to one another. The bridge 12 has a series of holes 15, and each linkage is formed, for example, by the association of a screw and a nut, the screw passing through a hole 15 of the bridge 12 and in a respective hole of one of the plates, 10, 11.

Alternatively, other structures can be used in place of the linkages 13, 14.

The crampon includes points 20 projecting in the area of the supporting surface 8. More specifically, the rear plate 10 carries points 20, for example four, oriented substantially perpendicular to the supporting surface. Similarly, the front plate 11 carries points 20, for example eight, six of which are oriented substantially perpendicular to the supporting surface 8, and two of which are oriented obliquely and forwardly, in the extension of the front plate 11. While all of the points 20 enable a grip into the snow or ice, on a horizontal or inclined ground, the two forward-oriented points enable a grip into a vertical or steeply inclined wall. Ultimately, the crampon 1 is very versatile in terms of its grip. However, other arrangements can be provided.

The crampon 1 also includes a first member 21 for retaining the boot 2 in the area of the receiving surface 9. The retaining member 21 will be described in more detail later, but it should be mentioned here that it is movable between a locking position and an unlocking position.

The crampon 1 further comprises an elastic mechanism 22 which biases the retaining member 21 toward the locking position. The elastic mechanism 22 is further described below.

According to the invention, on the side of the receiving surface 9, the crampon 1 comprises a return 23 adapted to cooperate with the boot 2, the return 23 biasing the first retaining member 21 toward the unlocking position when the boot 2 approaches the receiving surface 9, the return 23 allowing the first retaining member 21 to move back to the locking position when the boot is in position on the receiving surface 9. The return 23 receives energy supplied by the boot in approaching the crampon for attachment. A significant portion of this energy is transmitted to the locking member, that is, the first retaining member, to bring it into the unlocking position, which makes it possible to attach the crampon only by the action of the leg. In other words, no manual action is needed to attach the crampon. Therefore, the crampon 1 of the invention improves the safety of the user, because the user is not required to be in an unstable position to attach the crampon. It has been shown above that such a position, required with a crampon according to the prior art, involves bending down toward the ground, which can be dangerous at the edge of a crevasse or along a ridge, or bending one leg while balancing on the other. In addition to providing improved safety, crampon attachment using the crampon 1 according to the invention is easy and fast.

According to the first embodiment of the invention, and in a non-limiting manner, as shown in FIGS. 1-5, the elastic mechanism 22 includes a blade, the retaining member 21 includes a lug, the blade 22 and lug 21 being fixed to one another or they are made as one-piece. In a non-limiting manner, the lug 21 is formed by bending the free end of the blade 22. As shown in the drawing, the lug 21 has a freely projecting end, the lug projecting toward the receiving surface 9.

Here, more specifically, the elastic mechanism is embodied as the blade 22, the blade being bent and affixed to the body 3, that is to say, to the rear plate 10 by a fastening arrangement shown in the form of rivets 24. But this arrangement may be comprised of screws, fastening lugs, or any equivalent. The blade 22 is a spring which biases the lug 21 toward a locking position, which is obtained when the lug 21 retains the boot 2 on the crampon 1. The retaining means 21 is formed by the lug 21. Together, the blade and the lug have a simple, easy to manufacture structure.

By way of example, the elastic mechanism 22 and the retaining member 21 form a unitary element, that is, a one-piece element. In this case, the lug 21 is the bent free end of the element, whereas the blade forms the base thereof for connecting it to the body 3. This simplifies the element formed by the association of the elastic mechanism 22 with the retaining member 21 to a maximum.

In a non-limiting manner, the blade 22 is made of steel and has a thickness between 0.5 mm and 2.5 mm. As a corollary, the lug 21 is also made of steel, its thickness also being between 0.5 mm and 2.5 mm. Therefore, they can be easily manufactured with common tools known to one of ordinary skill in the art. Alternatively, however, other metals or other manufacturing equipment can be used, including synthetic materials which may or may not be reinforced with fiber glass, carbon, or the like.

For the first embodiment of the invention, the elastic mechanism 22 and the retaining member 21 are located in the area of the rear end 4 of the crampon 1. This makes it possible to retain the rear end 25 of the boot 2, as explained below. Alternatively, the elastic mechanism and the retaining member may be provided to be arranged elsewhere on the crampon 1, for example in the area of the front end 5.

The return 23 is also located in the area of the rear end 4, because the return 23 is formed by an inclined surface 26 of the retaining member 21. The return 23 is defined by the folded lug 21. More specifically, this means that the lug 21 has a surface that defines the return 23. It follows that the structure of the crampon 1 is very simple, particularly in that, here, the elastic mechanism 22, the retaining member 21 and the return 23 form a unitary element. In other words, the blade 22, the lug 21, and the return 23 form a unitary element, i.e., a one-piece element.

For example, the inclined surface 26 of the return 23 and the body 3 are provided to form an angle $\alpha$ between 45° and 85°, knowing that angle values between 55° and 80° have yielded good results.

Further to the foregoing, the crampon 1 comprises a second retaining member 27 formed, by way of a non-limiting example, by a stirrup. Because the first retaining member 21 is located at the rear, the second retaining member 27 is located in the area of the front end 5. Alternatively, a reverse arrangement can be provided, in which the first retaining member 21 is at the front and the second retaining member 27 is at the rear. In any case, the role of the second member is explained below.

The crampon 1 further comprises a linkage 28 located in the area of the rear end 4. The linkage 28 is formed, for example, by a strap adapted to surround a portion of the boot 2, for the sake of safety. The strap 28 forms a loop that can be open or closed, and is adjustable lengthwise, to constitute a retaining system as defined in the NF EN 893:2011-01 standard. Such retaining system can be regarded as a boot binding strap.

Figure 3:
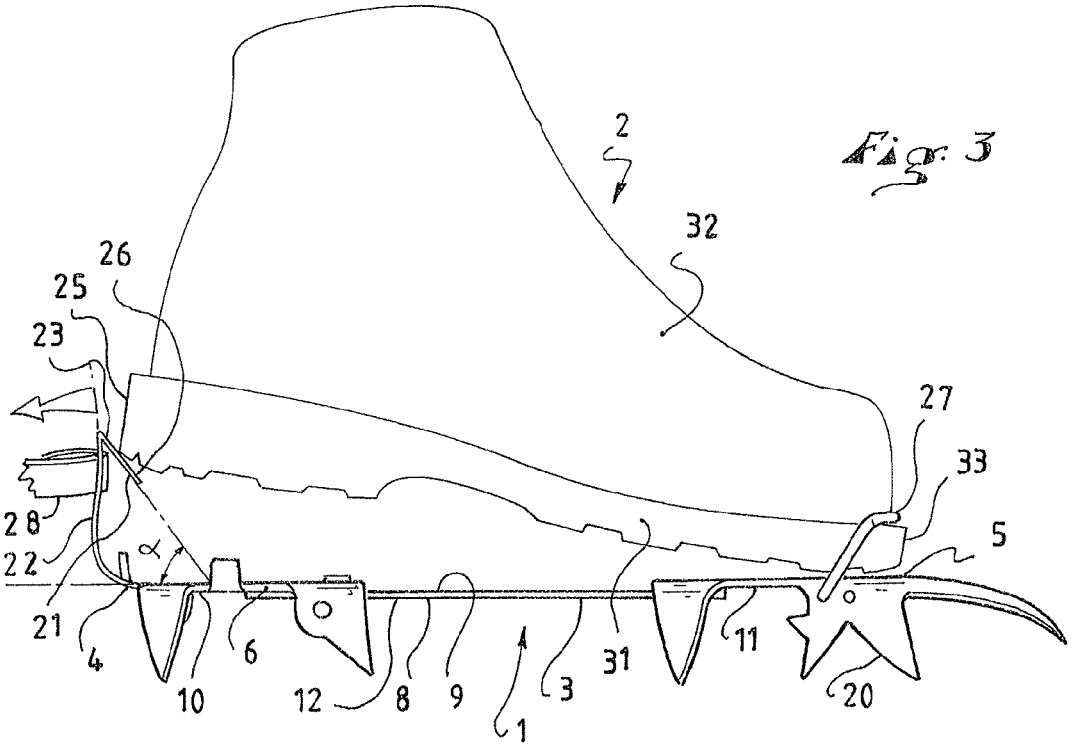
FIG. 3 is a side view of an assembly comprising a boot and the crampon of FIG. 1, with the boot being brought closer to the crampon for attachment.
Figure 4:
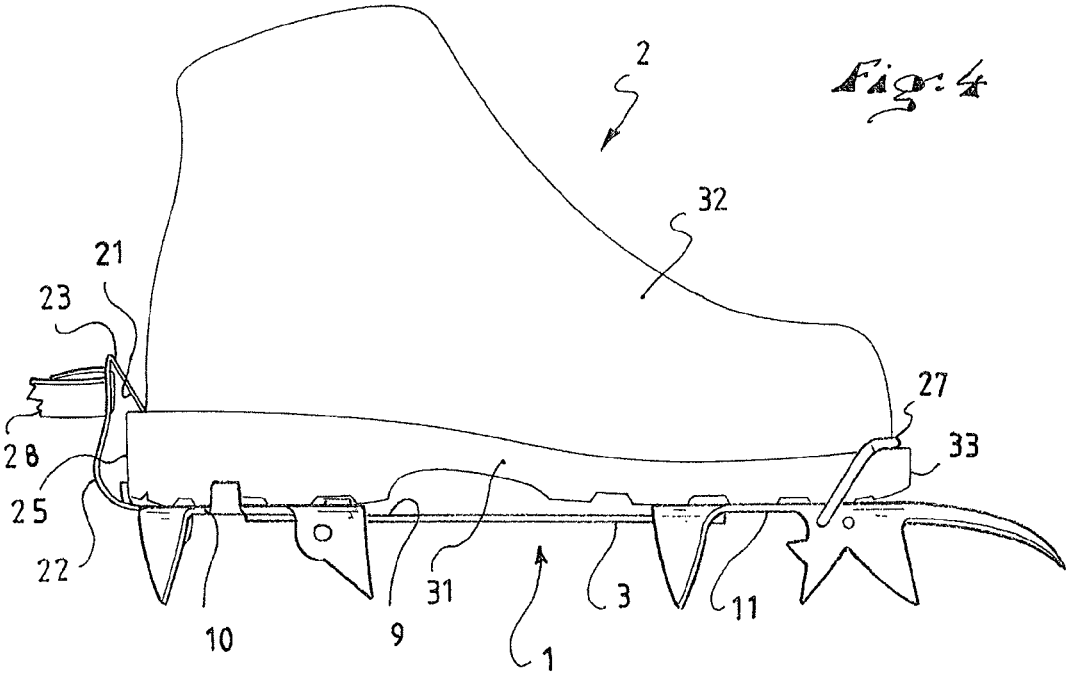
FIG. 4 is a view similar to FIG. 3, with the boot having been attached to the crampon.
Figure 5:
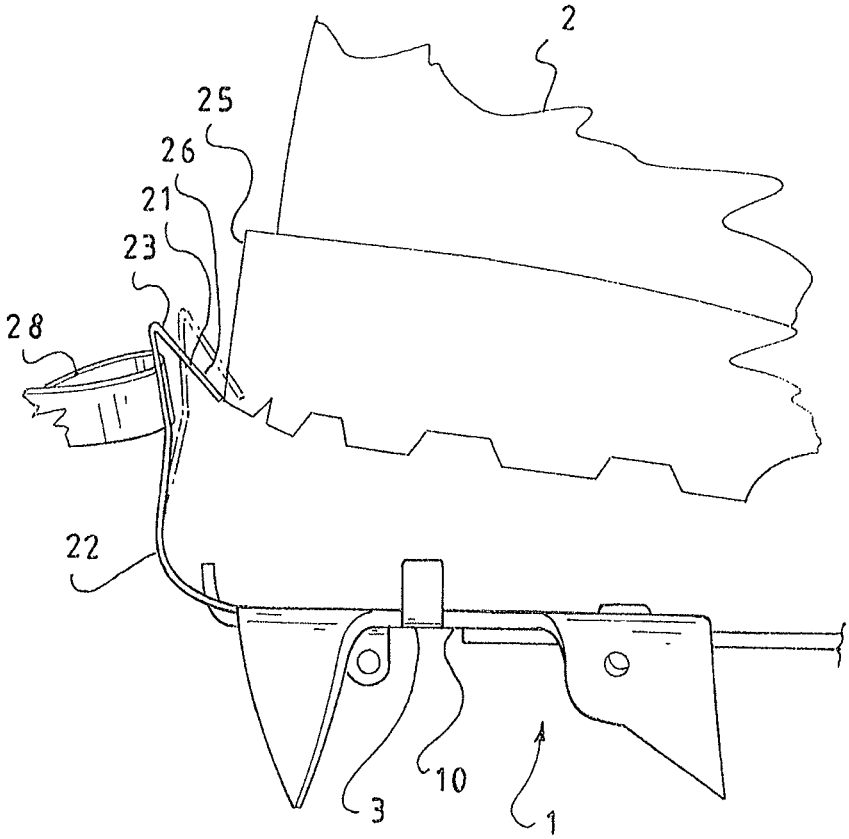
FIG. 5 is a view similar to FIG. 3, showing the action of the boot on the return of the crampon.

The crampon attachment operation, with reference to FIGS. 3-5, can now be simply explained. The boot 2 is structured to cooperate with each of the first 21 and second 27 retaining members. The boot 2 comprises a sole assembly 31 and an upper 32. In a non-limiting manner, the sole assembly 31 projects rearward, in the area of the rear end 25 of the boot. Similarly, the sole assembly 31 projects forward, in the area of the front end 33 of the boot. Each projection of the sole assembly demarcates a supporting surface for a retaining member 21, 27. Alternatively, other structures could be provided to cooperate with the crampon 1.

At the beginning of the crampon attachment, as shown in FIG. 3, the user positions the boot 2 above the receiving surface 9 by first engaging the front of the boot with the second retaining member 27. In this case, the forward projection of the sole assembly 31 is engaged with the stirrup 27. In this crampon attachment initial phase, the front end 33 of the boot is supported on the body 3, that is to say, on the front plate 11. Next, the user presses with the heel towards the body 3 in order to bring the rear end 25 of the boot to press on the body 3, that is to say, on the rear plate 10, as is the case in FIG. 4. This is the crampon attachment final phase, as the rear of the boot 2 is retained on the crampon 1 by the first retaining member 21. Thus, the front and rear of the boot are retained on the body 3 of the crampon 1 by the second 27 and first 21 retaining members, respectively.

The crampon attachment is made possible, only using the leg, by the action of the return 23 in conjunction with the elastic mechanism 22, as can be seen in FIG. 5. In fact, the sole assembly 31 presses on the return 23 and thereby biases it rearward against the action of the elastic mechanism 22. Here, the return 23 pushes the retaining member or lug 21 rearward, at the same time it causes the reversible elastic deformation of the elastic mechanism 22. The deformation lasts throughout the crampon attachment time, which corresponds to the passage of the sole assembly from one side to the other of the lug 21, in a direction towards the body 3. It can be easily understood that the crampon attachment is simple, easy, and fast. It suffices to place the crampon flat on the ground, and then to engage the front of the boot before pressing with the heel. In addition, as defined in the NF EN 893: 2011-01 standard, the strap 28 is tightened around the boot 2 to provide a second level of retention. This arrangement is well-known, per se, to one with ordinary skill in the art.

Conversely, detachment of the crampon is obtained through release of the strap, and manual disengagement of the first retaining member 21.

Figure 6:
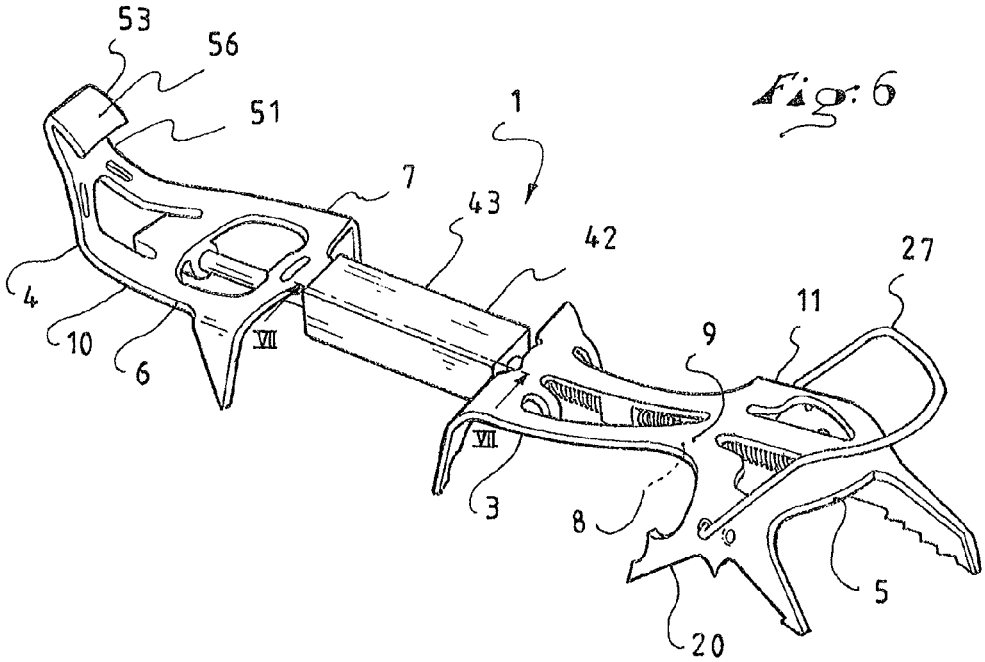
FIG. 6 is similar to FIG. 1, according to a second embodiment of the invention.

The second embodiment of the invention is shown below with reference to FIGS. 6 and 7. For reasons of convenience, the elements shared with the first embodiment are designated by the same reference numerals. Thus, only the differences are highlighted.

Therefore, the second embodiment features a crampon 1. What is specific here is that the body 3 includes a rear plate 10 and a front plate 11, and that the elastic mechanism 42 connects the rear 10 and front 11 plates to one another. Compared to the previous embodiment, it can be said here that the elastic mechanism 42 replaces the bridge 12 between the plates 10, 11. It is then more clearly understood that during crampon attachment, the plates 10, 11 move away from and then move closer to one another, these movement being caused by the action of the return 23 in combination with the action of the elastic mechanism 42.

By way of non-limiting example, the elastic mechanism 42 includes a guide 43 affixed to one of the rear 10 and front 11 plates, an rod 44 affixed to the other of the rear 10 and front 11 plates, as well as an elastic member 45 which biases the rear 10 and front 11 plates towards one another. The guide 43 and the rod 44 enable the crampon 1 and the body 3 to deform reversibly lengthwise against the action of the elastic member 45.

Figure 7:
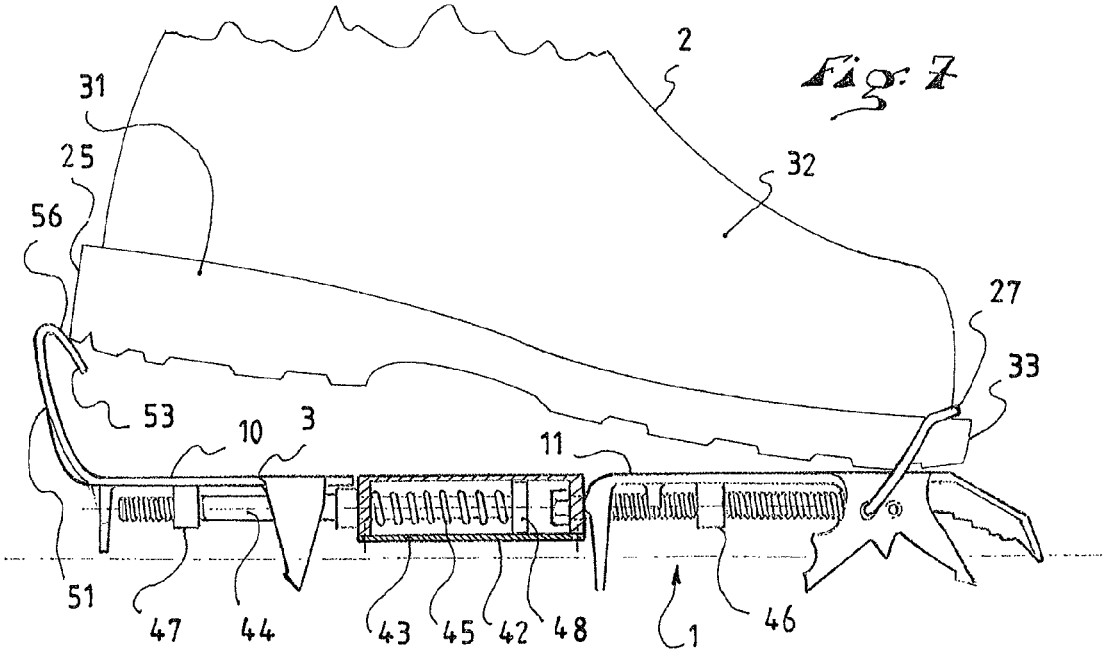
FIG. 7 is a view similar to FIG. 3, for the second embodiment, with a partial cross section indicated by the line VII-VII in FIG. 6.

As understood with reference FIG. 7, the guide 43 is a sheath, the rod 44 takes place in the sheath, and the elastic member 45 is a spring, such as a compression spring. The latter is made in the form of a helical coil, although other structures may be suitable.

In more specific terms, the sheath 43 is affixed to the front plate 11 by a screw-nut connection 46, and the rod 44 is affixed to the rear plate 10 by a screw-nut connection 47. The rod 44 has a shoulder 48 housed in the sheath 43 and the spring 45 acts in the sheath to push the shoulder 48 toward the front plate 11. As a result, the rear 10 and front 11 plates are elastically biased toward one another.

Further, in the second embodiment of the invention, the first retaining member 51 is a hook, which has the advantage of being easy to manufacture. Indeed, the hook 51 is made of a bent plate. More precisely, the hook is an extension of the body 3. In a non-limiting manner, the hook 51 and the rear plate 10 form a unitary, i.e., one-piece, element.

The return 53 is formed by an inclined surface 56 of the retaining member or hook 51. This gives a simple structure to the assembly formed by the retaining member 51 and the return 53.

In a particular embodiment, the inclined surface 56 of the return 53 and the body 3 form an angle $\alpha$ between 45° and 85°. Good results can be obtained for angle values between 55° and 80°.

In addition, without limitation, the first retaining member 51 is located in the area of the rear end 4. This makes it possible, as in the first embodiment, to retain the rear of the boot.

The crampon attachment occurs as in the first embodiment of the invention: the front 33 of the boot is positioned in the area of the second retaining member 27; the rear end 25 is then lowered by pressing on the return 53 in the area of the hook 51. The rear 10 and front 11 plates move away from one another, along the length of the crampon 1, during crampon attachment. Indeed, the hook is rigid, that is to say, substantially non-deformable, and therefore transmits the action of the boot on the return 53 to the rear plate 10. When the crampon attachment has occurred, the retaining member is in a locking position, against the boot and the plates 10, 11 are moved closer to one another.

The invention is made from materials and according to techniques of implementation known to one of ordinary skill in the art.

The invention is not limited to the particular embodiments described above, and includes all technical equivalents that fall within the scope of the claims that follow.

In particular, other structures can be provided for the retaining members.

For example, the return and the retaining member can be provided to be two distinct elements connected to other portions of the crampon by a fixed linkage, or by an articulation associated with an elastic mechanism.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A crampon comprising:

a body extending lengthwise from a rear end to a front end, widthwise between a first edge and a second edge, and heightwise between a supporting surface and a receiving surface;

points projecting in an area of the supporting surface;

a first boot-retaining member designed to retain a boot in an area of the receiving surface;

the first boot-retaining member designed to move between a boot locking position and a boot unlocking position;

an elastic mechanism designed to bias the first retaining member toward the boot locking position;

on a receiving surface side of the crampon, the elastic mechanism comprising:

an upwardly extending portion; and a return having an upwardly facing surface inclined downwardly away from the upwardly extending portion, the upwardly facing surface designed to cooperate with the boot;

the upwardly facing surface of the return being configured to bias the first boot-retaining member toward the unlocking position in response to the boot approaching the receiving surface while engaging the upwardly facing surface; and the upwardly facing surface of the return further configured, in response to a final approaching movement of the boot ending with the boot in place on the receiving surface and the crampon attached to the boot, to allow the first boot-retaining member to be moved to the locking position.

2. A crampon according to claim 1, wherein:

the elastic mechanism comprises a blade;

the first boot-retaining member comprises a lug; and the blade and the lug are affixed to one another.

3. A crampon according to claim 1, wherein:

the lug extends downwardly to a freely projecting end, the end projecting toward the receiving surface.

4. A crampon according to claim 1, wherein:

the elastic mechanism and the first boot-retaining member form a unitary, one-piece, element.

5. A crampon according to claim 2, wherein:

the blade is made of steel and has a thickness between 0.5 mm and 2.5 mm.

6. A crampon according to claim 1, wherein:

the elastic mechanism and the first boot-retaining member are located in an area of the rear end.

7. A crampon according to claim 1, wherein:

the inclined surface of the return and the body form an angle between 45° and 85°.

8. A crampon according to claim 1, wherein:

the body comprises a rear plate, a front plate, and a bridge connecting the rear and front plates to one another.

9. A crampon according to claim 1, wherein:

the body comprises a rear plate and a front plate;

the elastic mechanism connects the rear and front plates to be elastically movable in relation to one another.

10. A crampon according to claim 8, wherein:

the body of the crampon further comprises a front plate and a rear plate;

the elastic mechanism comprises:

a guide affixed to one of the rear and front plates;

a rod affixed to the other of the rear and front plates and being guided for movement by the guide; and an elastic member designed to bias the rear and front plates towards one another.

11. A crampon according to claim 10, wherein:

the guide is a sheath;

the rod is positioned within the sheath; and the elastic member is a spring.

12. A crampon according to claim 1, wherein:

the first boot-retaining member is a hook.

13. A crampon according to claim 12, wherein:

the hook is formed by a bent plate.

14. A crampon according to claim 8, wherein:

the inclined surface of the return and the body form an angle between 45° and 85°.

15. A crampon according to claim 1, wherein:

the first boot-retaining member is located in an area of the rear end.

16. A crampon according to claim 1, further comprising:

a second boot-retaining member located in an area of the front end.

17. A crampon according to claim 1, further comprising:

a boot-binding strap located in an area of the rear end.

18. A crampon according to claim 1, wherein:

the inclined surface extends in a direction downwardly and toward one of the rear and front ends of the body of the crampon to a free end of the inclined surface.

19. A crampon designed to be fitted to a boot only by a movement of a user's leg, the crampon comprising:

a body comprising:

a length extending between a front end and a rear end;

a width extending between a first side and a second side;

at least one upwardly facing receiving surface for receiving at least a portion of the boot; and a downwardly facing supporting surface;

a plurality of points downwardly projecting from the body, the points designed to grip a ground surface;

a first boot-retainer designed to retain one of the front and rear ends of the boot on the at least one upwardly facing boot-receiving surface;

the first boot-retainer configured to be moved between a boot locking position and a boot unlocking position;

the first boot-retainer comprising an inclined surface extending in a direction downwardly and toward one of the rear and front ends of the body of the crampon to a free end area of the inclined surface;

an elastic biaser configured to do the following:

apply an elastic force in a direction toward the boot unlocking position in response to said one of the front and rear ends of the boot being moved downwardly against the inclined surface of the first boot-retainer in a direction toward the one upwardly facing receiving surface of the body of the crampon; and maintain the first boot-retainer in the boot locking position against an upwardly directed force away from the upwardly facing receiving surface of the body of the crampon by the free end area of the inclined surface being engaged with a surface of the boot in the boot locking position of the first boot-retainer.

20. A crampon according to claim 19, wherein:

the first boot-retainer is designed to retain the rear end of the boot;

the crampon further comprises a second boot-retainer designed to retain the front end of the boot when the first boot-retainer is in the boot locking position.

21. A crampon according to claim 19, wherein:

the surface of the first boot-retainer is inclined at an angle, in relation to the one upwardly facing receiving surface of the body of the crampon, of between 45° and 85°.

* * * * *